US006382068B1

(12) United States Patent
Balke

(10) Patent No.: US 6,382,068 B1
(45) Date of Patent: May 7, 2002

(54) STRIP-SHAPED OR RECIPROCATING KNIFE

(76) Inventor: Axel Balke, Dellenfeld 34, Solingen (DE), 42653

( * ) Notice: Subject to any disclaimer, the term of this patent is extended or adjusted under 35 U.S.C. 154(b) by 0 days.

(21) Appl. No.: 09/530,135

(22) PCT Filed: Nov. 5, 1998

(86) PCT No.: PCT/DE98/03223

§ 371 Date: Apr. 27, 2000

§ 102(e) Date: Apr. 27, 2000

(87) PCT Pub. No.: WO99/24228

PCT Pub. Date: May 20, 1999

(30) Foreign Application Priority Data

Nov. 3, 1997 (DE) ..... 197 49 561

(51) Int. Cl.[7] ..... B26B 9/02
(52) U.S. Cl. ..... 83/847; 30/355
(58) Field of Search ..... 30/355, 346.56; 26/104.1, 112; 83/847

(56) References Cited

U.S. PATENT DOCUMENTS 817,361 A * 4/1906 Brown et al. ..... 30/355
3,994,065 A * 11/1976 Plum ..... 30/355 X
4,823,467 A * 4/1989 Campbell et al. ..... 30/355
4,907,344 A * 3/1990 Hahn ..... 30/355
6,108,915 A * 4/2000 Verdier et al. ..... 30/355

FOREIGN PATENT DOCUMENTS

DE 43 41 398 C1 3/1995

* cited by examiner

*Primary Examiner*—Douglas D. Watts
(74) *Attorney, Agent, or Firm*—Diller, Ramik & Wight

(57) ABSTRACT

A strip-shaped or reciprocating knife has at least ore elongated cutting blade (1) provided with a plurality of cutting teeth (2) and intermediate cutting gaps (5), the cutting teeth (2) being provided with additional, finer teeth (8). In order to achieve from beginning to end a smooth and clean cut of the goods to be cut, the additional teeth (8) are produced by providing opposite tooth spaces (9) on both sides of the knife, arranged so close to one another that sharp teeth (12) are formed between the spaces. The additional teeth provided on both sides of the knife form a sharp cutting edge which is symmetrically arranged on both sides of the knife and extends over the cutting teeth (2).

9 Claims, 1 Drawing Sheet

STRIP-SHAPED OR RECIPROCATING KNIFE

BACKGROUND OF THE INVENTION

The invention relates to a strip-shaped or reciprocating knife with at least one elongated cutting blade provided with numerous cutting teeth and intermediate cutting gaps, the cutting teeth being provided with additional, finer teeth.

A strip-shaped knife of this kind is known from DE 41 38 025 A1. The cutting edge of the strip-shaped knife disclosed in this document consists of oblique ground surfaces on one or both sides of the knife. If the ground surface is on one side, the tooth spaces of the additional teeth are also provided on one side. If there are ground surfaces on both sides, the tooth spaces of the additional teeth are cut into the ground surfaces in alternating sections of both sides of the knife.

If only one side of the cutting edge of the known knife has an oblique ground surface with tooth spaces cut into it, the two sides of the cutting edge are asymmetrical to one another along their entire length. One disadvantage of this asymmetrical design has proven to be the fact that, when cutting the material, the knife is deflected from its linear path, transverse to the direction of motion towards the side facing away from the ground surface. Thus, a straight, smooth cut cannot be achieved.

The fact that, on a cutting edge with ground surfaces on both sides, the tooth spaces of the additional teeth are cut into consecutive, alternating sections of both sides, results in cutting sections in the tooth spaces of the additional teeth which are offset relative to one another in the transverse direction of the strip-shaped knife. The cutting sections, which are offset relative to one another over a specific width, lead to increased frictional resistance when cutting the material. The frictional resistance causes the knife and he cut material to heat up. In addition, the offset of the cutting sections, which extends over a specific width, causes a loss of material. This lost material, or other residue from the material, easily becomes trapped in the cutting gaps and tooth spaces of the additional teeth. If further heating occurs, the lost material and residue clogs the knife, this being particularly noticeable in the case of fresh baked goods. Thus, a lateral offset of the cutting sections does not produce an optimally smooth, clean cut into and through the material.

Moreover, the manufacture of the strip-shaped knifed known from DE 41 38 025 A1 is relatively complex. In order to produce the cutting edge, the oblique ground surfaces are first applied on both sides of the strip-shaped knife. This is followed by the grinding of the undulating cutting teeth, the cutting gaps and the additional teeth in specific, alternating sections on both sides.

SUMMARY OF THE INVENTION

The present invention is based on the object of designing a strip-shaped or reciprocating knife which ensures an optimally smooth, clean cut into and through the material and is simple to manufacture.

According to the invention, the object is solved in that the additional teeth on a strip-shaped or reciprocating knife of the type described at the beginning are produced by providing opposite tooth spaces on both sides of the knife, arranged so close to one another that sharp teeth are formed between the spaces and that the additional teeth provided on both sides of the knife form a sharp cutting edge which is symmetrically arranged on both sides of the knife and extends over the cutting teeth.

The design of the strip-shaped or reciprocating knife according to the invention results in a cutting blade, the cross-section of which is symmetrical on both sides, with a cutting section extending over the cutting teeth in the plane of symmetry. This reduces the frictional resistance to a minimum. A smooth, clean cut of the material with a uniform cutting pattern is achieved. The loss of material to be cut is also substantially reduced. Due to the fact that the additional teeth provided on both sides form the cutting edge of the knife, the separate, preceding step of grinding the cutting blade in the form of ground surfaces on both sides of the knife can be dispensed with. This greatly reduces the complexity of manufacture.

The fine teeth preferably extend over the entire cutting blade, so that the cutting gaps are also provided with additional teeth.

In a particularly advantageous configuration, the fine teeth are manufactured by applying tooth spaces on both sides, such that teeth are formed between the tooth spaces provided and the teeth and tooth spaces are each opposite one another on both sides. The tooth spaces can be provided by grinding, milling or stamping, for example.

Surprisingly, the additional teeth according to the invention have shown that even high-speed strip-shaped Knives no longer heat up as much as conventional strip-shaped knives when cutting the product. On the one hand, this contributes to the material having far less of a tendency to clog the cutting gaps and cutting teeth, thus resulting in a uniform cut. On the other hand, the material to be cut can be processed at a higher temperature, thus shortening the cooling time of, for example, the baked goods to be cut, and enabling greater productivity of the entire production and work process.

It has also surprisingly become evident that the additional teeth substantially reduce noise generation, particularly that of high-speed strip-shaped knives, compared to conventional strip-shaped knives.

In a preferred configuration, the sections of the cutting teeth and cutting gaps sharpened on both sides are formed by the additional teeth provided on both sides.

The cutting teeth can be provided with a land on both sides.

The design of the fine cutting teeth can be adapted to the requirements of the product to be cut. In particular, the cutting teeth can be of acute design, such that their flanks on both sides are of concave shape and gradually merge into the likewise concave cutting gaps. On the other hand, the cutting teeth can be of convex shape, such that their flanks on both sides have a convex curve which merges into the concave curve of the cutting gaps.

BRIEF DESCRIPTION OF THE DRAWINGS

Three practical examples of the invention are described in more detail below based on the drawing. The drawing shows the following.

DESCRIPTION OF THE PREFERRED EMBODIMENTS

Figure 1:
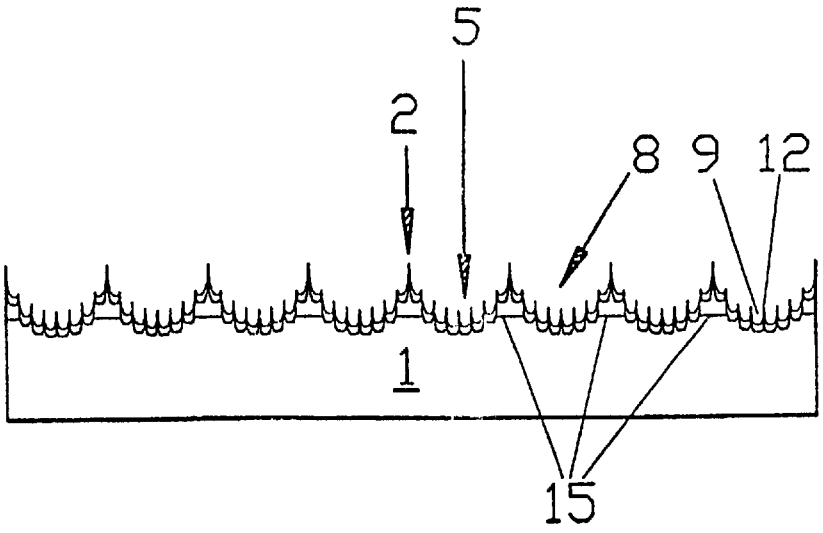
FIG. 1 A section of the cutting blade of a strip-shaped or reciprocating knife with acute cutting teeth, FIG. 2 A section of the cutting blade of a strip-shaped or reciprocating knife with acute cutting teeth, the spacing of which is greater than, and the height less than the cutting tips of the knife shown in FIG. 1, and FIG. 3 A section of the cutting blade of a strip-shaped or reciprocating knife with cutting teeth of convex shape.

As the drawing shows, the strip-shaped or reciprocating knife consists of at least one elongated cutting blade 1 provided with numerous cutting teeth 2, 3 and 4 and intermediate cutting gaps 5, 6 and 7. Cutting teeth 2, 3 and 4 and cutting gaps 5, 6 and 7 are sharpened with the same chamfer angle on both sides.

The sharpened sections of cutting teeth 2, 3 and 4 and cutting gaps 5, 6 and 7 are provided with additional, finer teeth 8. Teeth 8 are produced by grinding, milling or stamping tooth spaces 9, 10 and 11 on both sides, such that teeth 12, 13 and 14 are formed between tooth spaces 9, 10 and 11, and teeth 12, 13 and 14 and tooth spaces 9, 10 and 11 are each opposite one another on both sides. Additional teeth 8 arranged on both sides form the sharpened sections of cutting teeth 2, 3 and 4 and cutting gaps 5, 6 and 7. A separate, preceding step of sharpening cutting teeth 2, 3 and 4 and cutting gaps 5, 6 and 7 with a specific chamfer angle can thus be dispensed with.

However, cutting teeth 2, 3 and 4 are provided with a land 15 on both sides, such that teeth 12, 13 and 14 arranged on their tips display an acute cross-section.

Figure 2:
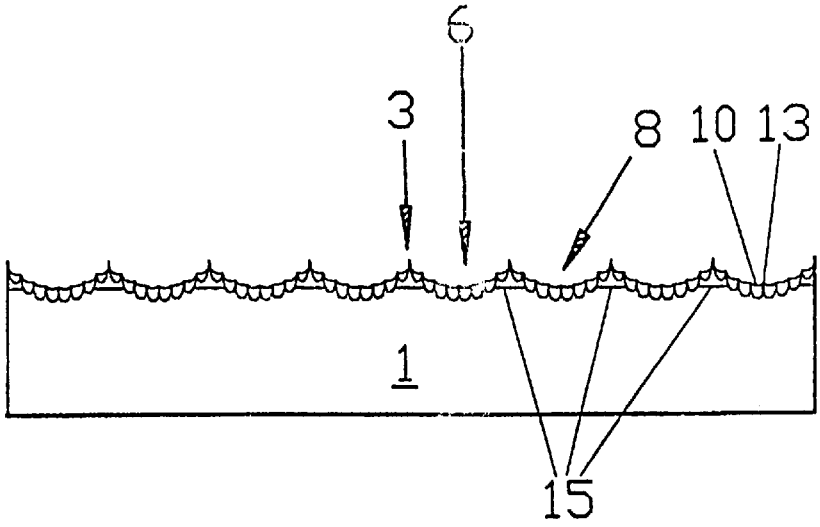

In the practical examples shown in FIGS. 1 and 2, cutting teeth 2 and 3 are of acute design in the side view. The two practical examples differ in the space between cutting teeth 2 and 3 and in their height.

Figure 3:
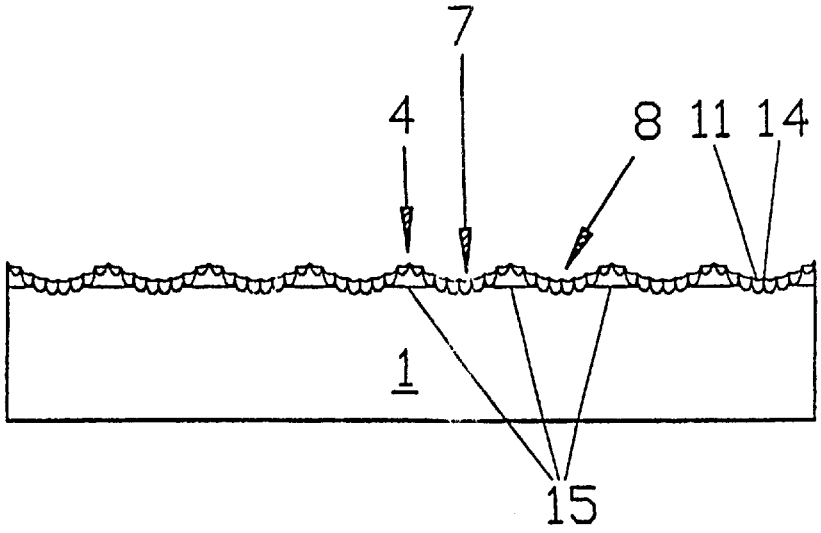

In the practical example shown in FIG. 3, cutting teeth 4 are of convex shape, where their flanks gradually merge into the concave curve of cutting gaps 7.

Although a preferred embodiment of the invention has been specifically illustrated and described herein, it is to be understood that minor variations may be made in the apparatus without departing from the spirit and scope of the invention, as defined the appended claims.

I claim:

1. A strip-shaped or reciprocating knife comprising at least one elongated cutting blade (1) provided with a plurality of cutting teeth (2, 3, 4) and intermediate cutting gaps (5, 6, 7), said cutting teeth (2, 3, 4) being provided with additional sharp smaller teeth (12, 13, 14), said additional sharp smaller teeth (12, 13, 14) being produced by opposite smaller tooth spaces (9, 10, 11) substantially contiguous each other on both sides of the cutting blade (1) at least along said cutting teeth (2, 3, 4), and said additional sharp smaller teeth (12, 13, 14) forming a sharp cutting edge symmetrically arranged on both sides of the cutting blade (1) extending longitudinally therealong.

2. The knife as defined in claim 1 wherein said additional sharp smaller teeth (12, 13, 14) are provided on both sides and extend the length of the intermediate cutting gaps (5, 6, 7).

3. The knife as defined in claim 1 wherein said plurality of cutting teeth (2, 3, 4) are provided with a land (15) on both sides.

4. The knife as defined in claim l wherein said plurality of cutting teeth (2, 3) define an acute angle in longitudinal cross-section.

5. The knife as defined in claim 1 wherein said plurality of cutting teeth (4) define a convex curve in longitudinal direction.

6. The knife as defined in claim 2 wherein said plurality of cutting teeth (2, 3, 4) are provided with a land (15) on both sides.

7. The knife as defined in claim 2 wherein said plurality of cutting teeth (2, 3) define an acute angle in longitudinal cross-section.

8. The knife as defined in claim 2 wherein said plurality of cutting teeth (4) define a convex curve in longitudinal direction.

9. The knife as defined in claim 3 wherein said plurality of cutting teeth (2, 3) define an acute angle in longitudinal cross-section.

* * * * *